US006722978B2

(12) United States Patent
Valenti

(10) Patent No.: US 6,722,978 B2
(45) Date of Patent: Apr. 20, 2004

(54) METHOD OF PLAYING A LINKED NUMERICAL GAME OF CHANCE WITH A BONUS AND PARLAY WAGERING OPTION

(75) Inventor: Mark Fitzpatrick Valenti, Henderson, NV (US)

(73) Assignee: Las Vegas Gaming, Inc., Las Vegas, NV (US)

( * ) Notice: Subject to any disclaimer, the term of this patent is extended or adjusted under 35 U.S.C. 154(b) by 155 days.

(21) Appl. No.: 10/143,358

(22) Filed: May 9, 2002

(65) Prior Publication Data

US 2003/0003981 A1 Jan. 2, 2003

Related U.S. Application Data

(60) Provisional application No. 60/289,916, filed on May 9, 2001.

(51) Int. Cl.[7] ..... A63F 3/06

(52) U.S. Cl. ..... 463/18; 463/17; 273/269; 273/274

(58) Field of Search ..... 463/16, 17, 18, 463/19, 25; 273/269, 274, 292

(56) References Cited

U.S. PATENT DOCUMENTS 4,842,278 A 6/1989 Markowicz
5,129,652 A * 7/1992 Wilkinson ..... 273/139
5,158,293 A * 10/1992 Mullins ..... 273/139
5,273,281 A * 12/1993 Lovell ..... 273/138.1
5,282,620 A 2/1994 Keesee
5,674,128 A 10/1997 Holch et al.
5,797,794 A 8/1998 Angell
5,909,875 A 6/1999 Weingardt
5,935,001 A * 8/1999 Baba ..... 463/18
6,024,641 A * 2/2000 Sarno ..... 463/17
6,102,400 A * 8/2000 Scott et al. ..... 273/269
6,270,407 B1 * 8/2001 Dodge ..... 463/18
6,315,290 B1 * 11/2001 Roethel et al. ..... 273/138.1
6,497,408 B1 * 12/2002 Walker et al. ..... 273/138.1
2002/0063387 A1 * 5/2002 Timpano ..... 273/274

* cited by examiner

*Primary Examiner*—Jessica Harrison
(74) *Attorney, Agent, or Firm*—Kevin J. Snyder

(57) ABSTRACT

The method of the present invention involves a numerical game of chance, which includes a parlay and a bonus playing option. A player selects a series of five (5) numbers from a set of eighty (80) numbers and makes a wager. The player then selects a second series of five numbers from a set of eighty numbers and makes another wager. The player then is given the option to make a combination wager whereby the first series of five numbers and second series of five numbers are combined. The gaming establishment then draws five winning numbers randomly from the set of eighty numbers. A player wins if his first series of five numbers matches the winning numbers, if his second series of five numbers matches the winning numbers or if any combination of the two series of numbers (i.e., ten numbers selected) matches the winning numbers. Additionally, bonus and parlay options are available.

6 Claims, 4 Drawing Sheets

FIG. 4

| | | | | | | | | | | | | | | | | | | | |
|---|---|---|---|---|---|---|---|---|---|---|---|---|---|---|---|---|---|---|---|
| 1 | 2 | 3 | 4 | 5 | 6 | 7 | 8 | 9 | 10 | 11 | 12 | 13 | 14 | 15 | 16 | 17 | 18 | 19 | 20 |
| 21 | 22 | 23 | 24 | 25 | 26 | 27 | 28 | 29 | 30 | 31 | 32 | 33 | 34 | 35 | 36 | 37 | 38 | 39 | 40 |
| 41 | 42 | 43 | 44 | 45 | 46 | 47 | 48 | 49 | 50 | 51 | 52 | 53 | 54 | 55 | 56 | 57 | 58 | 59 | 60 |
| 61 | 62 | 63 | 64 | 65 | 66 | 67 | 68 | 69 | 70 | 71 | 72 | 73 | 74 | 75 | 76 | 77 | 78 | 79 | 80 |

METHOD OF PLAYING A LINKED NUMERICAL GAME OF CHANCE WITH A BONUS AND PARLAY WAGERING OPTION

CROSS REFERENCE TO RELATED APPLICATIONS

This application is entitled to the benefit of Provisional Patent Application Ser. No. 60/289,916 filed May 9, 2001 entitled "A METHOD OF PLAYING A PROGRESSIVE GAME OF CHANCE USING MULTIPLE GAMING SITES".

BACKGROUND—FIELD OF INVENTION

This invention relates to the field of playing games of chance such as Keno or Lottery, which allows a player to potentially win a large sum of money by pre-selecting a series of numbers that may match a series of numbers randomly drawn by the gaming establishment for that game.

BACKGROUND OF THE INVENTION AND SUMMARY OF THE INVENTION

One of the most popular and well-recognized numerical games of chance is Keno. Traditionally, these games have been played by having a players select a series of numbers (e.g., five (5)) from a pool of numbers (e.g., one (1) through sixty (60)) along with placing a wager (e.g., $1(one dollar)) on the outcome of the game. The player is betting that the series of numbers he selected matches the series of winning numbers drawn by the gaming establishment (e.g., casino or restaurant). The player wins if his series of numbers matches the series of winning numbers drawn by the gaming establishment. Typically, the player who has an exact match (e.g., five out of five) wins the entire jackpot while he would win a portion of the jackpot or pre-determined amount of money if he selected four out of five, three out of five, two out of five or one out of five. The amount of money won by the player is usually pre-determined by the gaming establishment and are based upon a number of different factors including the mathematical probability of selecting the correct numbers which vary depending upon the pool of numbers selected from (e.g., 1 through 80) and the amount of money wagered on the game and number of people having winning matches.

Although traditional numerical games of chance such as Keno have been fairly popular and somewhat successful in generating large jackpots, the prior art has failed to recognize that a more exciting method of playing Keno can be created that would increase the number of players who would participate in the game which would result in higher revenue for the gaming establishments and higher payouts to the players. Typically months will go by before anyone hits the jackpot in traditional Keno, while one of the novelties of this invention is that the chances of someone winning the jackpot will increases substantially since the player can purchase two separate tickets and make a third wager to combine the selected numbers on each ticket. Also, by interconnecting different Keno game sites, a larger number of people can play the same games and, therefore, larger jackpots can be created much faster than traditional Keno by taking a percentage of all wagers from each individual Keno gaming sites and pooling them together. By creating larger jackpots this will encourage more players to participate in Keno games. Additionally, a player can increase his chances of winning by purchasing bonus numbers, which can be used in combination to the numbers chosen or selected initially. Also, another added feature allows the player to make a parlay wager whereby the player can bet that he will select one or more winning numbers on each of the two previous purchased ticket.

It is an object of the present invention to link a number of individual Keno gaming establishment sites together so that a percentage of wagers from each site can be pooled together to create a separate jackpot associated with a linked game in order to create larger jackpots.

It is also an object of the present invention to establish a combination wagering game wherein a player can place an additional wager that the combination of numbers contained on two tickets purchased separately will match the winning numbers.

It is also an object of the present invention to establish bonus numbers, which can be purchased separately by the player and used in addition to and in substitution for any of the numbers chosen initially by the player.

It is also an object of the present invention to establish a parlay wagering option whereby the player is betting that he will have one or more winning numbers on each purchased ticket.

DESCRIPTION OF THE DRAWINGS

FIG. 4 is a diagram showing an example of the pool numbers associated with the game.

DETAILED DESCRIPTION AND OPERATION OF THE PREFERRED EMBODIMENTS

FIG. 4 represents a diagram of the eighty numbers which are displayed at the gaming site and which encompass the numbers that may be drawn from by the player.

Figure 1:
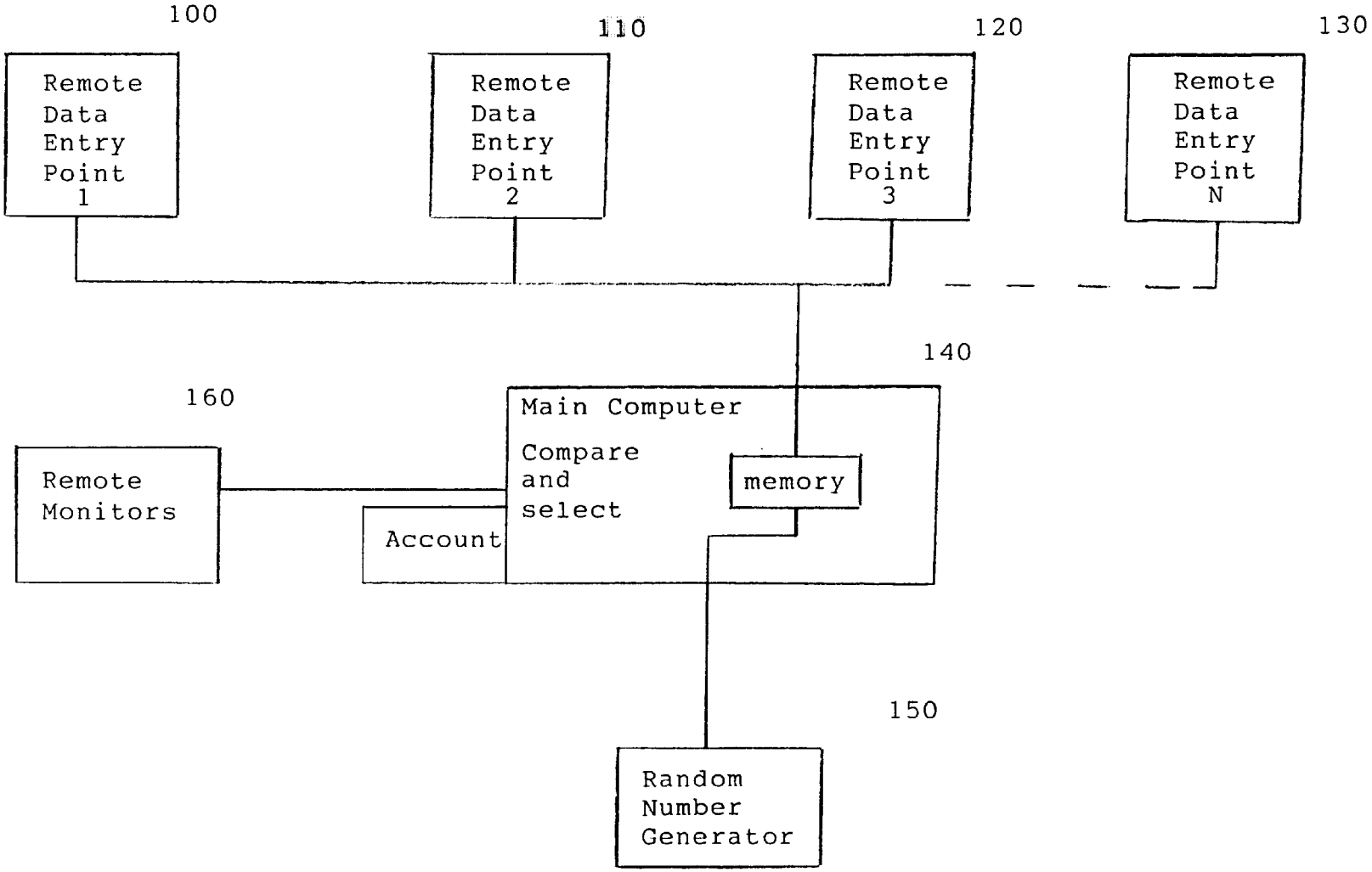
FIG. 1 is flow diagram showing the configuration of the game and showing how the game is played.

FIG. 1 represents an apparatus for playing the numerical game of chance according to an embodiment of the present invention (hereinafter referred to as the "system"). The system consists of numerous data entry points (100, 110, 120, and 130) (herein collectively referred to as 100) that exist throughout a given gaming site location (e.g., casino). The data entry points consist of a computer monitor with a keyboard. Each data entry point is directly connected to a main computer 140 so as to allow information to flow from 100 to 140. The data entry point 100 is designed so as to allow a player to select a series of game numbers from a set of acceptable game numbers which are then transmitted to the computer 140 were they can be received stored and accepted.

Figure 2:
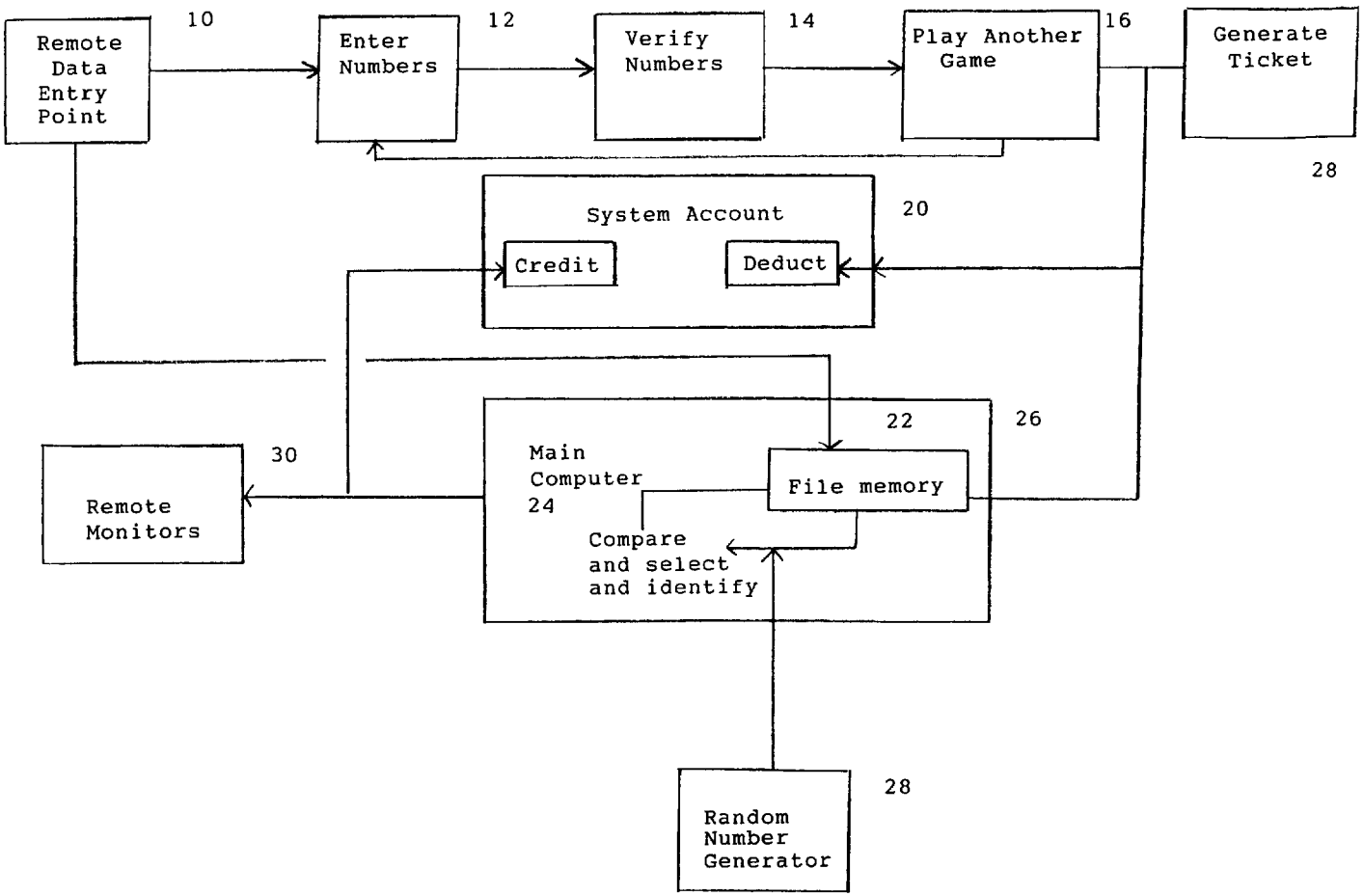
FIG. 2 is a flow diagram showing the configuration of how the independent Keno games are linked.

FIG. 2. shows how the invention is played. The player selects a first series of five (5) numbers from the list of eighty (80) numbers similar to that shown in FIG. 4. The player enters these numbers into the data entry point 10 and 12. When prompted by the system, the player verifies that his selections are correct 14. If acceptable, the player must then place a wager (e.g., $1) on his selection. The player then selects a second series of five numbers from the list of eighty numbers. The player enters these numbers into the data entry point 10 and 12. When prompted by the system, the player verifies that his selections are correct 14. If acceptable, the player must then place a wager (e.g., $1) on his second selection. The player is then offered to wager on a combination game wherein the numbers of the first and second series of five numbers selected by the player will be combined to determine if they match with the five winning game numbers. All selections and bets are stored in the system 26 and a print out 18 is generated and provided to the player. The player is given an opportunity to play additional games by repeating steps 12 and 14. At a certain predetermined time, the system will randomly draw a series of five winning game numbers (hereinafter "winning numbers") by selecting from the set of eighty numbers using a random number generator 28. The series of winning numbers will be transmitted to the computer 26 and displayed by remote monitors 30 located throughout the gaming establishment. The player can then compare his selections with the winning numbers. The player will be paid a predetermined percentage of money wagered on that game if the player's selections from the first series of five numbers exactly match the winning numbers or if the player's selections from the second series of five numbers exactly match the winning numbers. Additionally, if the player purchased a combination game ticket, the player will be considered a winner and be paid a predetermined percentage of money wagered on that game if any combination of the first series of five numbers and the second series of numbers match the series of five (5) winning numbers drawn.

In the preferred embodiment of the invention, the player may also, in the alternative to the selecting of the second series of five numbers or in addition to the selecting of the second series of five numbers, purchase one (1) to five (5) bonus numbers at the data entry point 12. These bonus numbers which are selected from one of the eighty numbers previously identified will also be used in combination with the first and, if applicable the second series of five numbers, to determine if the player is a winner by obtaining a match of the winning numbers. Additionally, the player is given the option to make a parlay wager on whether he will obtain one or more winning numbers in each of the two series of five numbers selected. If the player makes a parlay wager, he will be determined a winner and be paid a pre-determined percentage of the jackpot if he has at least one winning number on the first series of five numbers and also at least one winning number on the second series of numbers that match the series of five (5) winning numbers drawn. The more winning numbers the player has on each of the two tickets purchased, the larger the payout.

Figure 3:
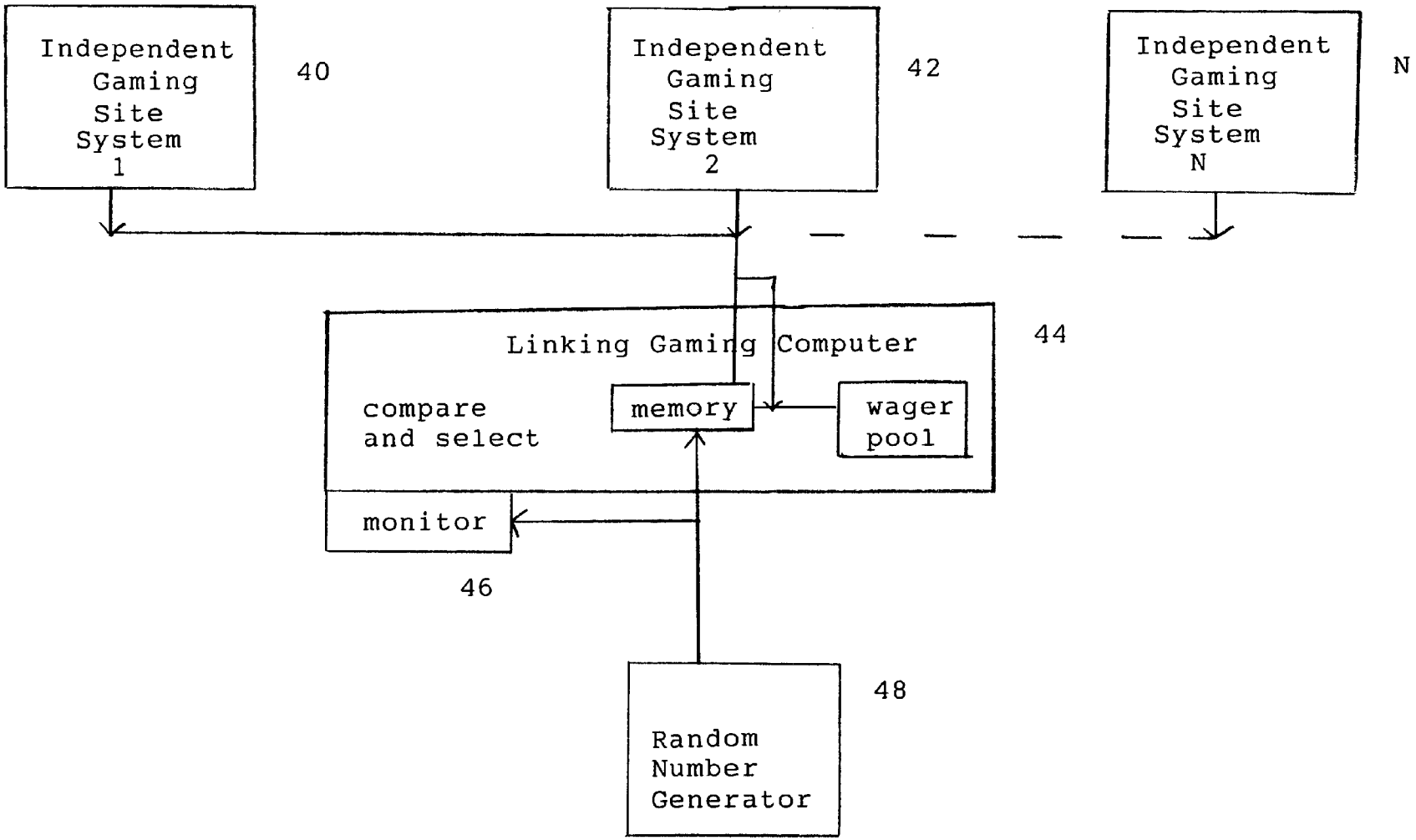
FIG. 3 is a flow diagram showing how information is transmitted, stored and utilized during the playing of the linked numerical game of chance.

FIG. 3 represents a method of playing a linked numerical game of chance. The object of this invention is to increase the jackpot by interconnecting several individual Keno games together. The system is configured so that each individual gaming site establishment (40, 42, etc.) (hereinafter collectively referred to as 40) is connected to a linked computer 44 so as to allow information such as numbers selected and wagers to be transmitted from 40 to 44. Each time a player makes a wager at one of the individual gaming sites 40, a certain predetermined percentage (e.g., 10%) is transmitted to the linked computer 44 where it is received, accepted and stored. As the wagers come into the computer 44 they are pooled together to form a jackpot. All players at the individual gaming sites have an opportunity to play the linked game, which is played exactly the same way as the game identified in FIG. 1.

What is claimed is:

1. A method of playing a numerical game of chance comprising:

(a) a player selecting a first series of five (5) numbers from a set of eighty (80) numbers and making a wager on said selection of first series of five numbers;

(b) a player selecting a second series of five (5) numbers from a set of eighty (80) numbers and making a wager on said selection for second series of five numbers;

(c) a player making a third wager, which is called a combination wager, based upon if any combination of the first series of five (5) numbers and the second series of five numbers match the series of five (5) winning numbers drawn;

(d) at a pre-specified time, the gaming establishment draws at random a series of five (5) winning numbers from a set of eighty (80) numbers;

(e) paying the player a pre-established percentage of the total amount wagered on the combination game if any combination of the first series of five (5) numbers and the second series of five (5) numbers match the series of five (5) winning numbers drawn.

2. A method of claim 1 additionally including:

(a) connecting a plurality of games operated at separate establishments disclosed in claim 1 together wherein all wagers from said games are pooled together.

3. A method of claim 1 additionally including;

(a) a player making a fourth wager, which is called a parlay wager, based upon if the player obtains one or more winning numbers in the first series of five (5) numbers and one or more winning numbers in the second series of five (5) numbers;

(b) paying the player a pre-established percentage of the total amount wagered on the game if the player obtains one or more winning numbers in the first series of five (5) numbers and one or more winning numbers in the second series of five (5) numbers.

4. A method of claim 1 additionally including:

(a) a player purchasing a series of one (1) to five (5) bonus numbers from a set of eighty (80) numbers;

(b) paying the player a pre-established percentage of the total amount wagered on the game if any combination of the first series of five (5) numbers, second series of five (5) numbers and the series of purchased bonus numbers match the series of five (5) winning numbers drawn.

5. A method of playing a numerical game of chance comprising:

(a) a player selecting a first series of five (5) numbers from a set of eighty (80) numbers and making a wager on said selection of first series of five (5) numbers;

(b) a player purchasing a series of one (1) to five (5) bonus numbers from a set of eighty (80) numbers;

(c) at a pre-specified time, the gaming establishment draws at random a series of five (5) winning numbers from a set of eighty (80) numbers;

(d) paying the player a pre-established percentage of the total amount wagered on the game if any combination of the first series of five numbers and any of the bonus numbers match the series of five (5) winning numbers drawn.

6. A method of claim 5 additionally including:

(a) connecting a plurality of games operated at separate establishments disclosed in claim 5 together wherein a percentage of all wagers are pooled together.

* * * * *